US010724360B2

(12) United States Patent
Purkis

(10) Patent No.: US 10,724,360 B2
(45) Date of Patent: Jul. 28, 2020

(54) WELL ISOLATION

(71) Applicant: Petrowell Limited, Aberdeenshire (GB)

(72) Inventor: Daniel George Purkis, Aberdeenshire (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 1151 days.

(21) Appl. No.: 14/431,497

(22) PCT Filed: Sep. 26, 2013

(86) PCT No.: PCT/GB2013/052515
§ 371 (c)(1),
(2) Date: Mar. 26, 2015

(87) PCT Pub. No.: WO2014/049360
PCT Pub. Date: Apr. 3, 2014

(65) Prior Publication Data

US 2015/0240628 A1 Aug. 27, 2015

(30) Foreign Application Priority Data

Sep. 26, 2012 (GB) ..... 1217229.2

(51) Int. Cl.
*E21B 47/00* (2012.01)
*E21B 33/10* (2006.01)
(Continued)

(52) U.S. Cl.
CPC ..... *E21B 47/00* (2013.01); *E21B 33/10* (2013.01); *E21B 33/12* (2013.01); *E21B 34/06* (2013.01);
(Continued)

(58) Field of Classification Search
CPC ..... E21B 47/00; E21B 33/12; E21B 34/00; E21B 47/124
See application file for complete search history.

(56) References Cited

U.S. PATENT DOCUMENTS 5,995,449 A 11/1999 Green et al.
6,199,628 B1 * 3/2001 Beck ..... E21B 23/06 166/53
(Continued)

FOREIGN PATENT DOCUMENTS

EP 2196622 A1 6/2010
GB 2313610 A 12/1997
(Continued)

OTHER PUBLICATIONS

International Search Report and Written Opinion received in corresponding PCT Application No. PCT/GB2013/052515, dated Aug. 27, 2014, 16 pages.
(Continued)

*Primary Examiner* — Robert E Fuller
*Assistant Examiner* — Lamia Quaim
(74) *Attorney, Agent, or Firm* — Blank Rome, LLP

(57) ABSTRACT

A system for isolating a wellbore having a fluid flow passage extending from surface to a subterranean location has a first, downhole, valve and a second, uphole, valve. The downhole valve is located in the wellbore at a first subterranean location and the uphole valve is located in the wellbore at a second subterranean location spaced from the first valve. Downhole valve is operable between a first configuration permitting access through the flow passage and a second, well isolation, configuration isolating the flow passage below the valve. Uphole valve is operable between a first configuration permitting access therethrough and a second, isolation, configuration providing an isolated or isolatable volume between the first and second valves. A pressure
(Continued)

sensor disposed in the isolated volume between the downhole valve and the uphole valve and, in use, permits a pressure in the isolated volume to be measured and/or communicated to a remote location.

20 Claims, 5 Drawing Sheets

(51) Int. Cl.

| | |
|---|---|
| ***E21B 34/06*** | (2006.01) |
| ***E21B 33/12*** | (2006.01) |
| ***E21B 47/06*** | (2012.01) |
| ***E21B 47/12*** | (2012.01) |
| ***E21B 47/14*** | (2006.01) |
| *E21B 34/00* | (2006.01) |

(52) U.S. Cl.

CPC ..... *E21B 47/06* (2013.01); *E21B 47/123* (2013.01); *E21B 47/124* (2013.01); *E21B 47/14* (2013.01); *E21B 2034/002* (2013.01)

(56) References Cited

U.S. PATENT DOCUMENTS

| | | | | |
|---|---|---|---|---|
| 8,866,632 | B2 * | 10/2014 | Hrametz | E21B 47/12 340/854.4 |
| 9,194,227 | B2 * | 11/2015 | Snider | E21B 47/12 |
| 9,243,477 | B2 * | 1/2016 | Solenthaler | E21B 28/00 |
| 9,686,021 | B2 * | 6/2017 | Merino | H04B 11/00 |
| 2005/0035874 | A1 | 2/2005 | Hall et al. | |
| 2005/0285753 | A1 | 12/2005 | Shah et al. | |
| 2006/0248949 | A1 | 11/2006 | Gregory et al. | |
| 2006/0272810 | A1 * | 12/2006 | Marsh | E21B 33/068 166/250.08 |
| 2007/0227727 | A1 * | 10/2007 | Patel | E21B 17/028 166/250.01 |
| 2008/0190605 | A1 * | 8/2008 | Clapp | E21B 33/1246 166/250.17 |
| 2008/0210431 | A1 | 9/2008 | Johnson et al. | |
| 2009/0050368 | A1 * | 2/2009 | Griffin | E21B 47/0006 175/40 |
| 2010/0163235 | A1 | 7/2010 | Mootoo et al. | |
| 2010/0301242 | A1 * | 12/2010 | Patton | E21B 34/10 251/129.01 |
| 2010/0313646 | A1 * | 12/2010 | Mehta | E21B 47/00 73/152.54 |
| 2011/0073368 | A1 * | 3/2011 | Han | E21B 47/01 175/40 |
| 2012/0037422 | A1 * | 2/2012 | Rasheed | E21B 10/32 175/50 |

FOREIGN PATENT DOCUMENTS

| | | | |
|---|---|---|---|
| GB | 2439187 | A | 12/2007 |
| WO | 2006133313 | A1 | 12/2006 |
| WO | 2010123585 | A2 | 10/2010 |

OTHER PUBLICATIONS

Search Report received in corresponding application No. GB1217229.2, dated Nov. 27, 2012, 1 page.

Examination Report in corresponding EP application No. 13771194.1, dated Jun. 30, 2017, 4 pages.

* cited by examiner

WELL ISOLATION

FIELD OF THE INVENTION

This invention relates to well isolation. More particularly, but not exclusively, embodiments of the invention relate to methods and systems for well isolation and/or for communicating the integrity of a well isolation to a remote location.

BACKGROUND TO THE INVENTION

In the oil and gas exploration and production industry, wellbores are drilled in order to access subsurface hydrocarbon-bearing formations. The viability of a well may vary in response to many factors. For example, in some instances the costs involved in producing hydrocarbons from a well may not justify its continued operation. This may be the case, for example, with a mature well where the most accessible hydrocarbons have been extracted and the costs associated with extracting the remaining hydrocarbons is or becomes prohibitive. Alternatively, in a well where the hydrocarbons are more readily accessible, the market cost of the produced hydrocarbons may dictate that the continued operation of the well is not commercially viable. In other instances, the wellbore may be abandoned due to technical issues.

Where it is desired to close a well, it is necessary to do so in a manner which prevents the escape of any hydrocarbons to the surrounding environment. The process may involve, amongst other things, the insertion of fluid, such as drilling mud, to kill the flow of hydrocarbons to surface, the introduction of cement into the wellbore to isolate hydrocarbon reservoirs from each other or from surface, or the removal of bore-lining tubing or other equipment located at surface or on the seabed. The well may then be capped, for example by locating a wellhead on the well.

It will be recognised that the closure of a well is a complex and expensive procedure, in particular in the case of subsea wells or wells in other remote locations.

There are, however, a number of situations where it may be desired to regain access to the well. For example, advances in technology may make the previously inaccessible or uneconomical extraction of hydrocarbons viable. Alternatively, market value of the extracted hydrocarbons may increase to a point where the extraction of hydrocarbons from the well becomes commercially viable.

However, re-opening of an abandoned or closed well is technically challenging and expensive, and may not be feasible in many instances if indeed it is possible using conventional techniques and equipment.

SUMMARY OF THE INVENTION

According to a first aspect of the present invention, there is provided a system for isolating a wellbore having a fluid flow passage extending from surface to a subterranean location, the system comprising:

a first, downhole, valve member configured for location in the wellbore at a first subterranean location and moveable between a first configuration which permits access through the flow passage and a second configuration which isolates the flow passage below the valve member;

a second, uphole, valve member configured for location in the wellbore at a second subterranean location spaced from the first valve member and moveable between a first configuration which permits access through the second valve member and a second configuration which provides an isolated volume between the first and second valve members.

In use, the system may be operable to define at least a well isolation configuration and a well communication or access configuration.

The system may be operable to define the well isolation configuration when at least one, and in particular embodiments both, of the first and second valve members are configured in the second configuration. The downhole valve member may facilitate selective isolation of the flow passage and may provide a primary barrier to the uncontrolled release of fluid from the well when in the second configuration. The uphole valve member may provide a secondary barrier to the uncontrolled release of fluid from the well when in the well isolation configuration. The uphole valve member may facilitate the creation of the isolated volume between the first and second valve members when both the first and second valve members are in the second configuration.

By providing the isolation at a subterranean location, any loss in the integrity of the isolation may be detected earlier and before loss of wellbore fluid to the environment. Moreover, in subsea well isolation applications where the isolation is provided below the seabed, embodiments of the present invention may utilise the hydrostatic fluid pressure in the wellbore above the uphole valve member to prevent or mitigate loss of wellbore fluid in the event of loss of isolation integrity.

The system may be operable to define the well communication or access configuration when both of the first and second valve members are configured in the first configuration.

The system may be configured to provide access into the isolated volume when the second valve member is configured in the first configuration.

The first and second valve members may be configured for location at any required location or depth in the wellbore. In some embodiments, the first and second valve members may be located at a depth range of about 5 metres to about 3000 metres from the earth surface, or in the case of subsea applications from the seabed. In particular embodiments, the first and second valve members may be located at a depth of about 1000 metres from the earth surface or from the seabed.

The system may comprise a monitoring arrangement for obtaining information relating to a condition in the isolated volume. For example, the monitoring arrangement may be configured to obtain information relating to the integrity of the isolation. The monitoring arrangement may be of any suitable form and/or construction. The monitoring arrangement may comprise a sensor and in particular embodiments the sensor may comprise a pressure sensor for measuring the fluid pressure in the isolated volume.

The monitoring arrangement, or part of the monitoring arrangement, may be configured for location in the isolated volume between the first valve member and the second valve member.

The monitoring arrangement, or part of the monitoring arrangement, may be configured for location outwith the isolated volume between the first valve member and the second valve member. For example, part or all of the monitoring arrangement may be disposed at an uphole location relative to the isolated volume. In embodiments where part or all of the monitoring arrangement is disposed outwith the isolated volume, the monitoring arrangement may nevertheless communicate with the isolated volume. For example, the monitoring arrangement may comprise a fluid conduit for communicating with the isolated volume. In particular embodiments, the fluid conduit may provide communication between the isolated volume and a sensor disposed outwith the isolated volume. Alternatively, or additionally, the monitoring arrangement may comprise an electrical or optical arrangement, such as a wire, optic cable, for communicating with the isolated volume. In particular embodiments, the electrical or optical arrangement may provide communication between the isolated volume and a sensor disposed outwith the isolated volume.

The system may comprise a memory device for storing the information obtained by the monitoring arrangement.

The system may comprise a communication arrangement for communicating information relating to the condition in the isolated volume to a remote location. The communication arrangement may communicate with and transmit data from the monitoring arrangement. For example, the communication arrangement may be configured to communicate the information relating to the integrity of the isolation to the remote location. In particular embodiments, the communication arrangement may be configured to communicate the fluid pressure in the isolated volume to the remote location.

At least part of the communication arrangement may be configured for location in the isolated volume between the first valve member and the second valve member.

Alternatively, or additionally, at least part of the communication arrangement may be configured for location outwith the isolated volume between the first valve member and the second valve member. For example, at least part of the monitoring arrangement may be disposed at an uphole location relative to the isolated volume.

The communication arrangement may be of any suitable form and/or construction. By way of example, the communication arrangement may comprise at least one of: a wireless communication arrangement; an acoustic communication arrangement; a wired communication arrangement; an electric line communication arrangement; an optical communication arrangement; a waveguide communication arrangement, optical fibre or the like. The communication arrangement may comprise an acoustic communication arrangement operable in the very low frequency (VLF) and/or low frequency (LF) range. In particular embodiments, the communication arrangement may comprise an acoustic communication arrangement operable at a frequency of about 22 kHz.

The system may comprise a power supply for supplying power to at least one of the monitoring arrangement, the communication arrangement and the memory device. The power supply may be of any suitable form and/or construction. For example, the power supply may comprise a battery or battery pack. In particular embodiments, the power supply may comprise an alkaline battery or battery pack.

The communication arrangement may be configured to directly transmit or otherwise relay the information relating to the condition in the isolated volume to the remote location. However, in particular embodiments the communication arrangement may be configured to transmit or otherwise relay the information relating to the condition in the isolated volume to the remote location via at least one intermediate location.

The at least one intermediate location may comprise a first intermediate location and the system may comprise a first receiver/transmitter or transceiver disposed at the first intermediate location. The first intermediate location may be any suitable location. For example, the first receiver/transmitter or transceiver may be located at a subterranean location in the wellbore. The first receiver/transmitter or transceiver may, for example, be located in the wellbore at a relatively short distance from the monitoring arrangement or sensor. The first receiver/transmitter or transceiver may, for example, be located in the wellbore at a distance of about 1 metre to about 100 metres from the monitoring arrangement or sensor. In particular embodiments, the first receiver/transmitter or transceiver may be located in the wellbore at a distance of about 20 metres from the monitoring arrangement or sensor Beneficially, the communication arrangement, the power supply and the first receiver/transmitter or transceiver may be configured, operable and/or positioned so that the information relating to the condition in the isolated volume may be communicated to the first receiver/transmitter or transceiver reliably.

In particular embodiments, the first receiver/transmitter or transceiver be configured to relay the information received from the communication arrangement via a wired communication arrangement, such as an electric line, waveguide or the like. Alternatively, or additionally, the first receiver/transmitter may be configured to transmit the information wirelessly, for example acoustically. The first receiver/transmitter may be configured to transmit the information up to between about 1000 metres and 5000 metres. Beneficially, the first receiver/transmitter or transceiver may be used to relay the information relating to the condition in the isolated volume over a relatively large distance, for example but not exclusively from a location near to the isolation to the seabed or to surface.

The system may comprise a power supply for supplying power to the first receiver/transmitter or transceiver. The power supply for supplying power to the first receiver/transmitter or transceiver may be of any suitable form and/or construction. For example, the power supply may comprise a battery or battery pack. In particular embodiments, the power supply may comprise an alkaline battery or battery pack. The power supply may comprise an onboard power supply provided at the first intermediate location. Alternatively, or additionally, power may be supplied to the first receiver/transmitter or transceiver remotely.

The first receiver/transmitter or transceiver may be configured to directly transmit or otherwise relay the information to the remote location.

However, in particular embodiments the at least one intermediate location may comprise a second intermediate location and the first receiver/transmitter or transceiver may be configured to transmit or otherwise relay the information via a second receiver/transmitter or transceiver at the second intermediate location. The second intermediate location may be any suitable location. For example, the second receiver/transmitter or transceiver may be located at a subsurface location, for example but not exclusively on the seabed. In particular embodiments, the second receiver/transmitter may be configured to transmit the information wirelessly, for example but not exclusively acoustically. The second receiver/transmitter or transceiver may be configured to operate in the very low frequency (VLF) and/or low frequency (LF) range. In particular embodiments, the second receiver/transmitter or transceiver may be configured to operate at a frequency of about 15 kHz. The second receiver/transmitter or transceiver may, for example, be configured to transmit information over a range of up to about 1000 metres to about 5000 metres. Alternatively, or additionally, the second intermediate receiver may be configured to relay the information via a wire, such as electric line, waveguide or the like.

The system may comprise a power supply for supplying power to the second receiver/transmitter or transceiver. The power supply for supplying power to the second receiver/transmitter or transceiver may be of any suitable form and/or construction. For example, the power supply may comprise a battery or battery pack. In particular embodiments, the power supply may comprise an alkaline battery or battery pack. The power supply for supplying power to the second receiver/transmitter or transceiver may comprise an onboard power supply provided at the second intermediate location. The power supply for supplying power to the second receiver/transmitter or transceiver may also supply power to the first receiver/transmitter or transceiver via the wired communication arrangement.

The remote location may comprise at least one of a vessel, a buoy, a platform or a rig. Alternatively, or in addition, the remote location may comprise an onshore facility. The remote location may comprise a receiver for receiving the information from the sensor or from the at least one intermediate location.

At least one of the power supplies, the monitoring arrangement, the communication arrangement and the memory device may be configured for retrieval. At least one of the power supply, the monitoring arrangement, the communication arrangement and the memory device may be configured for retrieval by a wireline tool, fishing tool, remotely operated vehicle (ROV) or the like. In embodiments where the power supply comprises a battery or battery pack, the power supply may be configured for retrieval so that the battery or batteries may be replaced or recharged. By way of example, the power supply for supplying power to the second receiver/transmitter or transceiver may be configured for retrieval by an ROV, for example but not exclusively via a wet stab operation or the like.

In use, the communication arrangement may be configured to relay the information relating to the condition in the isolated volume at a given interval. For example, the communication arrangement may be configured to relay the information once per hour.

The communication arrangement may be configured to receive information or commands.

In some embodiments, the communication arrangement may be configured to receive information instructing a change in the information transmitted from the communication arrangement. The change may comprise the rate of information transmission from the communication arrangement. In particular embodiments, the rate of information transmission from the communication arrangement may be increased in response to the condition of the isolated volume. In the event of a change in pressure, which may for example indicate a reduction in integrity of the isolation, the communication arrangement may be instructed to increase the frequency at which the information is transmitted. Beneficially, this may permit a more detailed analysis of the change in condition to be performed and appropriate action taken.

In other embodiments, the communication arrangement may be configured to receive information instructing a change in the status of the system. For example, the communication arrangement may be configured to receive information instructing that the system turn off, turn on and/or enter a stand-by or hibernation state.

In other embodiments, the communication arrangement may be configured to receive information requesting a status of at least part of the system. For example, the communication arrangement may be configured to receive information requesting the status of the power supply, battery life of the like.

The system may comprise a sensor for obtaining information relating to a condition below the downhole valve member. The sensor for obtaining information relating to a condition below the lower valve member may comprise a pressure sensor.

The system may comprise a sensor for obtaining information relating to a condition above the uphole valve member. The sensor for obtaining information relating to a condition above the upper valve member may comprise a pressure sensor.

The system may comprise a body for running the first and second valve members into the wellbore.

The first valve member may be provided on or mounted to a body.

The second valve member may be provided on or mounted to a body.

The first valve member body and the second valve member body may be integral. Alternatively, the first valve member body and the second valve member body may comprise separate components. In embodiments where the first valve member body and the second valve member body comprise separate components, the first valve member body and the second valve member body may be configured for coupling together. The second valve member body may comprise a stinger configured to engage the first valve member body.

The first valve member body may comprise a tubular. The second valve member body may comprise a tubular. In some embodiments, the at least one of the first valve member body and the second valve member body may comprise a bore-lining tubular, such as casing or liner.

The isolated volume may comprise a volume of the flow passage. Alternatively, or additionally, the isolated volume may comprise a body passage.

The first valve member may comprise a barrier member, barrier valve or the like. In particular embodiments, the first valve member may comprise a ball valve.

The second valve member may comprise a barrier member, barrier valve or the like. In particular embodiments, the second valve member may comprise a ball valve.

The system may comprise a seal member for sealing an annulus between the body and a wall of the flow passage. The seal member may comprise an annular seal member. In particular embodiments, the seal member may comprise a packer or other suitable seal member. In use, the seal member may be configurable between a first, run-in configuration and a second, expanded configuration to engage the wall of the flow passage. In some embodiments, the system may comprise a single seal member. In other embodiments, the system may comprise a plurality of seal members, and in particular embodiments the system may comprise two seal members. The expanded seal members, the first and second valve members, the body and the flow passage wall may define the isolated volume.

According to a further aspect of the present invention, there is provided a method for isolating a wellbore having a flow passage extending from surface to a subterranean location, the method comprising:

locating a first, downhole, valve member at a first subterranean location in a wellbore;

locating a second, uphole, valve member at a second subterranean location in the wellbore spaced from the first valve member;

moving the first valve member between a first configuration which permits access through the flow passage to a second configuration which isolates the flow passage below the valve member; and moving the second valve member between a first configuration which permits access through the second valve member and a second configuration which provides an isolated volume between the first and second valve members.

The first and second valve members may be located in the bore sequentially. For example, the first valve member may be located in the bore and then the second valve member may be located in the bore. In particular embodiments, the first valve member and the second valve member may be located in the bore in a single trip.

Any suitable arrangement for locating the first and second valve members in the bore may be used. For example, locating the first and second valve members may comprise running the first and second valve members into the bore on a body.

The method may comprise performing an integrity test on the first valve member. The method may comprise performing an integrity test on the second valve member.

According to a further aspect of the present invention, there is provided a system for isolating a well, the system comprising:

a first valve member configured for location in a bore;

a second valve member configured for location in the bore, the first and second valve members arranged to provide an isolated volume therebetween; and a communication arrangement for transmitting information relating to the isolated volume to a remote location.

According to a further aspect of the present invention, there is provided a method for isolating a well, the system comprising:

locating a first valve member in a bore;

locating a second valve member in the bore, the first and second valve members arranged to provide an isolated volume therebetween; and providing a communication arrangement in the isolated volume and transmitting information relating to a condition in the isolated volume to a remote location.

According to a further aspect of the present invention, there is provided a tool for use in isolating a well having a fluid flow passage extending from surface to a subterranean location, the tool comprising:

a valve member configured for location in a bore and moveable between a first configuration which permits access through the flow passage and a second configuration which isolates the flow passage below the valve member; and a communication arrangement for transmitting information relating to the flow passage below the valve member to a remote location.

It should be understood that the features defined above in accordance with any aspect of the present invention or below in relation to any specific embodiment of the invention may be utilised, either alone or in combination, with any other defined feature, in any other aspect or embodiment of the invention.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
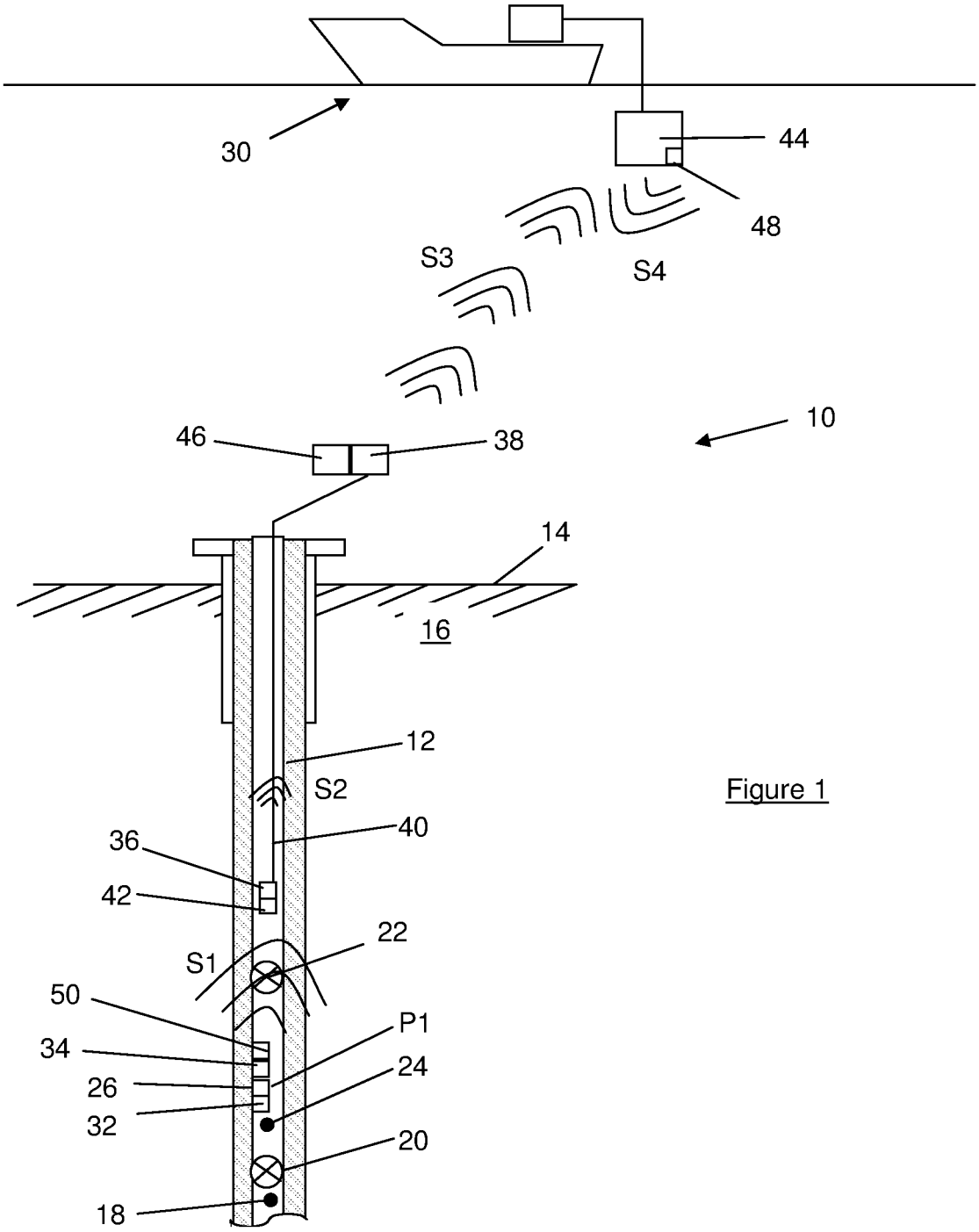
FIG. 1 is a diagrammatic view of a system for isolating a wellbore according to an embodiment of the present invention.

Referring first to FIG. 1, there is shown a diagrammatic view of a well isolation system 10 according to an embodiment of the present invention. In the illustrated embodiment, the system 10 comprises a subsea isolation system for isolating a wellbore 12 which extends from the seabed 14 into the earth 16 and defines a flow passage 18 for the extraction of well fluids (not shown).

As shown in FIG. 1, the system 10 comprises a first valve member in the form of downhole ball valve 20 and a second valve member in the form of uphole ball valve 22. It will be understood that the term downhole is used herein to mean that the valve 20 is disposed nearer to the toe (not shown) of the wellbore 12 and that the term uphole is used to mean that the valve 22 is disposed nearer to surface than valve 20.

In use, downhole valve 20 is moveable between a first configuration which permits access through the flow passage 18 and a second, well isolation, configuration which isolates the flow passage 18 below the valve 20. Downhole valve 20 thus provides a primary barrier to the uncontrolled release of well fluids when in the isolation configuration. In use, uphole valve 22 is moveable between a first configuration which permits access therethrough and a second, isolation, configuration which provides an isolated or isolatable volume 24 between the first and second valves 20, 22. Uphole valve 22 thus provides a secondary barrier to the uncontrolled release of well fluids when in the isolation configuration.

A pressure sensor 26 is disposed in the isolated volume 24 between the downhole valve 20 and the uphole valve 22 and, in use, the pressure sensor 26 permits a pressure P1 in the isolated volume 24 to be measured and/or monitored. By monitoring the pressure P1 in the isolated volume 24, for example by measuring any change in the pressure P1 over time, the integrity of the isolation provided by the downhole valve 20 may be monitored.

The system 10 further comprises a communication arrangement for transmitting the pressure information obtained by the sensor 26 to a remote location, in the illustrated embodiment a surface ship 30.

In the illustrated embodiment, the communication arrangement comprises an acoustic transmitter 32 disposed within the isolated volume 24 and which is operatively coupled to the pressure sensor 26. In use, the acoustic transmitter is configured to transmit the pressure information (shown diagrammatically by S1) obtained by the sensor 26 over a relatively short distance. In the illustrated embodiment, the acoustic transmitter 32 operates at a frequency of about 22 kHz and transmits the pressure information obtained by the sensor 26 over a range of about 20 metres.

A power supply, in the form of alkaline battery pack 34, is operatively coupled to the sensor 26 and the acoustic transmitter 32 and, in use, the battery pack 34 provides power to the sensor 26 and the acoustic transmitter 32. The battery pack 34 is located within the isolated volume 24 so that, when required, the battery pack 34 may be removed for replacement or recharging, for example by a retrieval tool such as a wireline tool, fishing tool or the like (not shown). The retrieval tool may access the battery pack 34 through the uphole valve 22 when in the open configuration. It will be recognised that the isolated volume 24 may be accessed while the primary barrier provided by the downhole valve 20 is maintained.

The system 10 may be configured to transmit the pressure information obtained by the sensor 26 directly to the surface ship 30. However, in the illustrated embodiment the pressure information is transmitted via a number of intermediate receiver/transmitters (two intermediate receiver/transmitters 36, 38 are shown in FIG. 1), which are described further below.

A first intermediate receiver/transmitter 36 is suspended in the flow passage 18 of the wellbore 12 by an electric line 40. A power supply in the form of alkaline battery pack 42 is operatively coupled to the first intermediate receiver/transmitter 36 for supplying power to the first intermediate receiver/transmitter 36. Alternatively, power may be supplied to the first intermediate receiver/transmitter 36 via the electric line 40 or other remote location. As can be seen from FIG. 1, the first intermediate receiver/transmitter 36 is disposed in the flow passage 18 of the wellbore 12 and, in use, receives the pressure information from the sensor 26 and relays this information (shown diagrammatically in FIG. 1 by S2) via the electric line 40 to the second receiver/transmitter 38. In the illustrated embodiment, the second receiver/transmitter 38 is located on the seabed 14 and the distance between the first intermediate receiver/transmitter 36 and the second receiver/transmitter 38 may be about 1000 metres. In use, the second receiver/transmitter 38 is configured to receive the pressure information from the first receiver/transmitter 36 and transmit the received information (shown diagrammatically in FIG. 1 by S3) to the surface ship 30. In the illustrated embodiment, the second receiver/transmitter 38 comprises an acoustic transmitter operating at a frequency of about 15 kHz and capable of transmitting the information obtained by the sensor 26 over a range of about 3000 metres. The surface ship 30 is also provided with a receiver 44 for receiving the pressure information transmitted from the second receiver/transmitter 38. A power supply in the form of alkaline battery pack 46 is operatively coupled to the second intermediate receiver/transmitter 38 for supplying power to the second intermediate receiver/transmitter 38. The power supply 46 may also supply power to the first receiver/transmitter 36 via the electric line 40, where desired.

It will be recognised that the intermediate receivers/transmitters 36/38 may be used in a number of different configurations and that in some embodiments a single intermediate receivers/transmitter may be used while in other embodiments more than one intermediate receivers/transmitter may be used. For example, in applications where the signal S2 is required to be communicated over a relatively short distance, such as about 100 metres, it is envisaged that the first intermediate receiver/transmitter 36 may be disposed at surface 14 or at the wellhead. In applications where the signal S2 is required to be communicated over a longer distance, such as 1000 metres, it is envisaged that the first intermediate receiver/transmitter 36 may be disposed either at surface 14 or at the wellhead or suspended in the wellbore 12 using a physical connector, such as the electric line 40 described above. In applications where the signal S2 is required to be communicated over a still longer distance, such as 5000 metres or more, it is envisaged that the first intermediate receiver/transmitter 36 may be suspended in the wellbore 12 using a physical connector, such as the electric line 40 described above.

In some embodiments, the communication arrangement may be configured to receive information (shown diagrammatically in FIG. 1 by S4) from a transmitter 48 provided on the surface ship 30, or from one or more of the intermediate receivers/transmitters 36,38 instructing a change in the information transmitted from the communication arrangement. In the illustrated embodiment, the communication arrangement comprises a receiver 50 for receiving the information S4.

Figure 2:
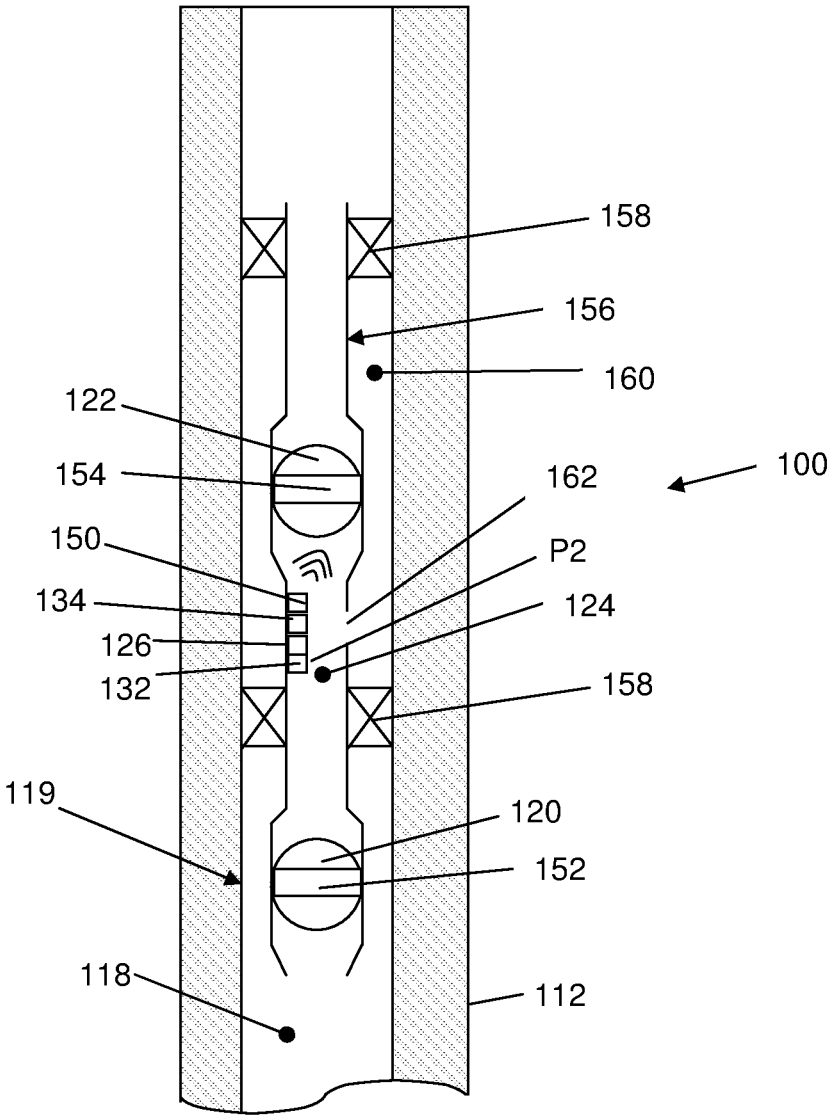
FIG. 2 is a diagrammatic view of a system for isolating a wellbore according to another embodiment of the present invention.

Referring now to FIG. 2 of the drawings, there is shown a diagrammatic view of a system 100 according to another embodiment of the present invention, the system 100 for isolating a wellbore 112 having a flow passage 118 for the extraction of well fluids (not shown). In the illustrated embodiment, the wellbore 112 is lined with bore-lining tubing in the form of casing 119 which has been cemented in place by cement 121.

It will be recognised that the system 100 or components thereof may be used in the system 10 described above and like components between the system 10 and system 100 are represented by like numerals incremented by 100.

As in the system 10, the system 100 comprises a first valve member in the form of downhole ball valve 120 and a second valve member in the form of uphole ball valve 122. As shown in FIG. 2, the downhole valve 120 has a flow passage 152 and the uphole valve 122 has a flow passage 154. In use, downhole valve 120 is moveable between a first configuration which permits access through the flow passage 118 (in which configuration the flow passage 152 is aligned with the flow passage 118) and a second, well isolation, configuration which isolates the flow passage 118 below the valve 120 (in which configuration the flow passage 152 is not aligned with flow passage 118). Downhole valve 120 thus provides a primary barrier to the uncontrolled release of well fluids when in the isolation configuration. In use, uphole valve 122 is moveable between a first configuration which permits access therethrough (in which configuration the flow passage 154 is aligned with flow passage 118) and a second, isolation, configuration which provides an isolated volume 124 between the first and second valves 120, 122 when both the downhole valve 120 and the uphole valve 122 are closed (in which configuration the flow passage 154 is not aligned with flow passage 118). Uphole valve 122 thus provides a secondary barrier to the uncontrolled release of well fluids when in the isolation configuration.

A pressure sensor 126 is disposed in the isolated volume 124 between the downhole valve 120 and the uphole valve 122 and, in use, the pressure sensor 126 permits a pressure P2 in the isolated volume 124 to be measured and/or monitored. By monitoring the pressure P2 in the isolated volume 124, for example by measuring any change in the pressure P2 over time, the integrity of the isolation provided by the downhole valve 120 may be monitored.

As with the first embodiment, the system 100 further comprises a communication arrangement having an acoustic transmitter 132 for transmitting the pressure information obtained by the sensor 126 to a remote location, such as the surface ship 30 shown in FIG. 1, the acoustic transmitter 132 disposed within the isolated volume 124 and operatively coupled to the pressure sensor 126.

A power supply, in the form of alkaline battery pack 134, is disposed in the isolated volume 124 and is operatively coupled to the sensor 126 and the acoustic transmitter 132 and, in use, the battery pack 134 provides power to the sensor 126 and the acoustic transmitter 132.

The system 100 may optionally comprise a receiver 150 configured to receive information or commands from the remote location, such as the surface ship 30.

In use, the apparatus 100 is configured for location in a flow passage 118 and is operable to isolate the flow passage 118 to prevent the uncontrolled release of well fluids (not shown) from the wellbore 112.

As can be seen from FIG. 2, the system 100 according to the second embodiment includes a body 156 for running the downhole valve 120 and the uphole valve 122 into the wellbore 112 in a single trip. In the illustrated embodiment, the body 156 comprises a unitary body, although it will be understood that the body 156 may alternatively comprise a plurality of body portions coupled together.

Seal members in the form of packers 158 are mounted around the outside of the body 156, the packers 158 operable to extend from a run-in configuration to a set configuration (as shown in FIG. 2) sealing off the annular volume 160 between the body 148 and the wellbore 112.

As can be seen from FIG. 2, in addition to defining an isolated volume 124 within the body 156 between the downhole valve 120 and uphole valve 122, a port 162 is provided in the body 156 and provides fluid communication with the annular volume 160 between the body 156, the wellbore 112 and the packers 158. In this way, the pressure sensor 126 is capable of detecting any change in pressure in the isolated volume 124 which may occur as a result of loss of sealing integrity of either of the packers 156 in addition to any loss in integrity of the isolation provided by the downhole valve 120.

Referring now to FIGS. 3 to 6, there are shown diagrammatic views of stages of a wellbore operation using the system 100 according to an embodiment of the present invention. As shown in FIGS. 3 to 6, the system 100 is disposed in the wellbore 112 and in FIGS. 3 to 5 a riser R is coupled to the uphole end of the body 156.

Figure 3:
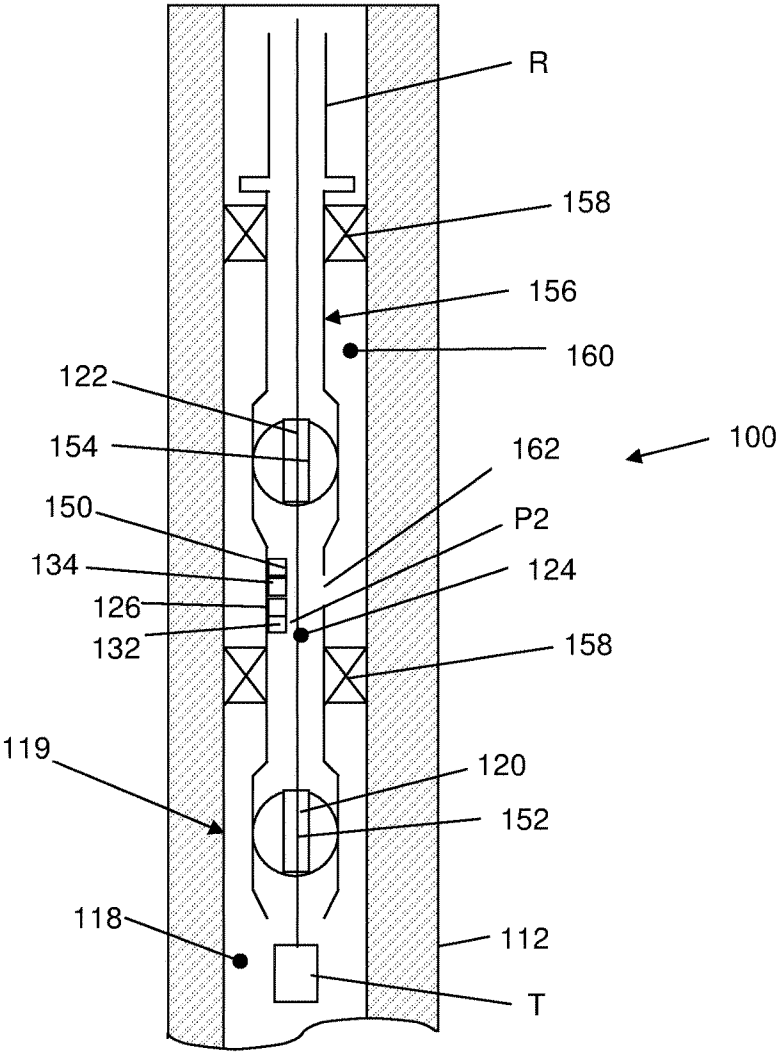
FIG. 3 is a diagrammatic view of a first stage of a wellbore operation using the system according to the present invention.

FIG. 3 shows the system 100 in a first configuration in which both the downhole valve 120 and the uphole valve 122 are open. In this configuration, the system 100 permits one or more tool T, such as a test tool, a production logging tool or other tool to be deployed into and retrieved from the wellbore 112 to permit operations to be performed in the wellbore 112 below the downhole valve 120.

Figure 4:
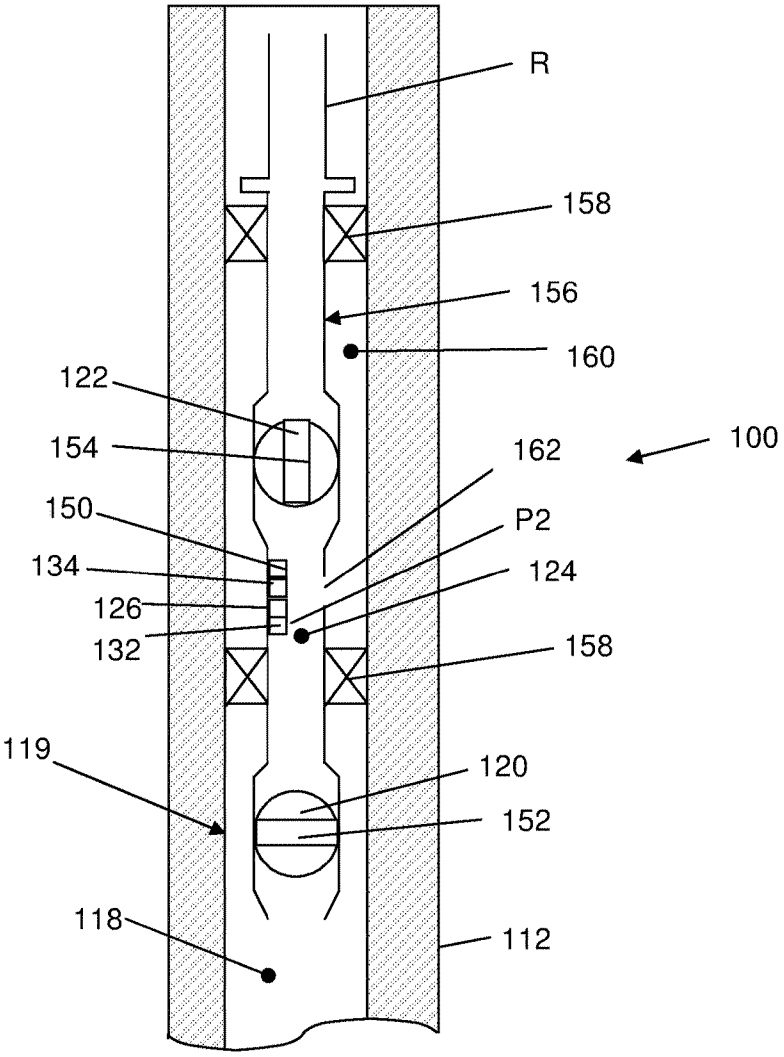
FIG. 4 is a diagrammatic view of a second stage of a wellbore operation using the system according to the present invention.

FIG. 4 shows the system 100 in a second configuration. In this configuration, the tool T has been retrieved and the downhole valve 120 has been closed, permitting the pressure integrity of the downhole valve 120 to be tested, for example by pressure testing from above via the riser R and/or by performing an inflow test from below.

Figure 5:
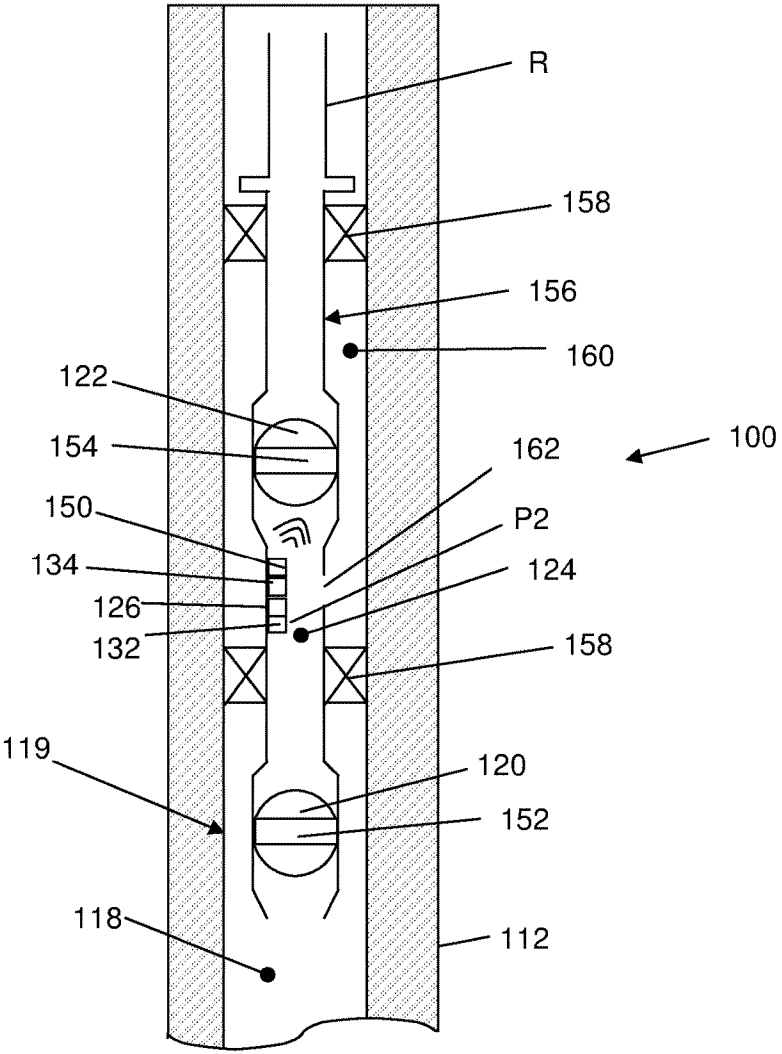
FIG. 5 is a diagrammatic view of a third stage of a wellbore operation using the system according to the present invention.

FIG. 5 shows the system 100 in a third configuration. Once the integrity of the downhole valve 120 has been verified, and as illustrated in FIG. 5, the uphole valve 122 may be closed to isolate the volume 124 within the body 156 between the downhole valve 120 and uphole valve 122. The pressure integrity of the uphole valve 122 may then be tested by monitoring the pressure P2 in the volume 124 using the sensor 126.

Figure 6:
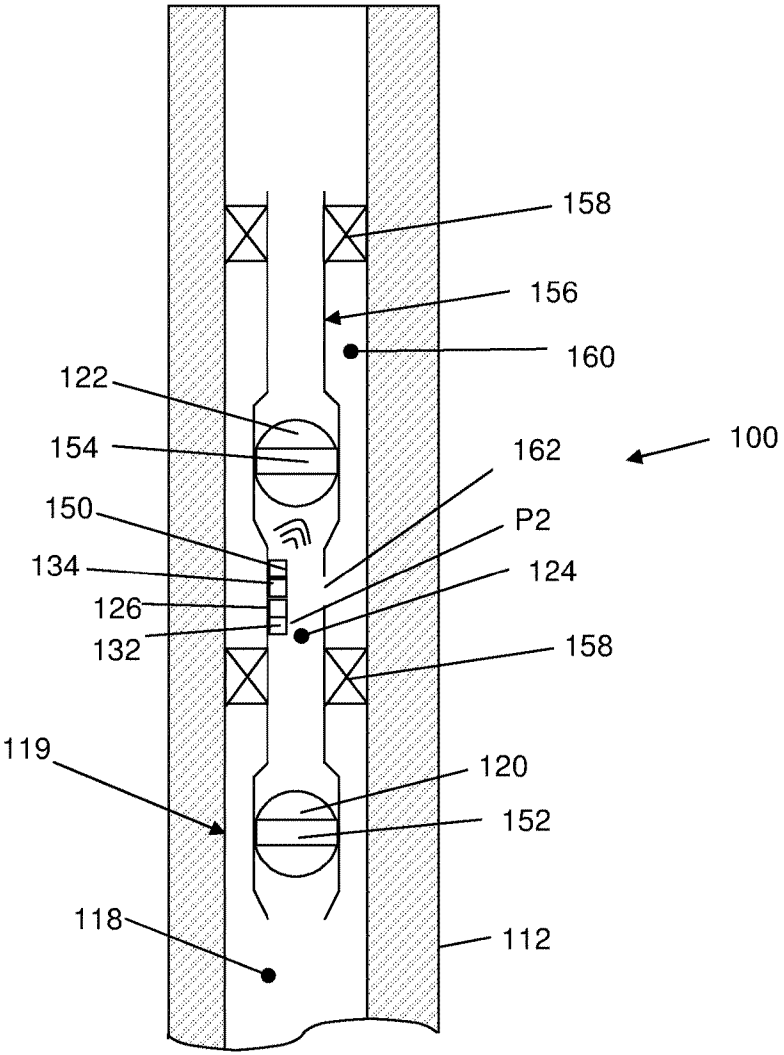
FIG. 6 is a diagrammatic view of a fourth stage of a wellbore operation using the system according to the present invention.

FIG. 6 shows the system 100 in a fourth configuration, which corresponds to that shown in FIG. 2. Once the integrity of the uphole valve 122 has been verified, the riser R may be disconnected. In this configuration, the wellbore 112 now defines a monitored shut-in configuration which permits intervention into the wellbore 112 where required.

It should be understood that the embodiments described herein is merely exemplary and that various modifications may be made thereto without departing from the scope of the invention.

For example, while in the illustrated embodiments described above, the sensor is disposed in the volume between the downhole valve and the uphole valve, in other embodiments one or more of the sensor, the power supply and the transmitter/receiver may be disposed at another location in the system outside of the volume.

Figure 7:
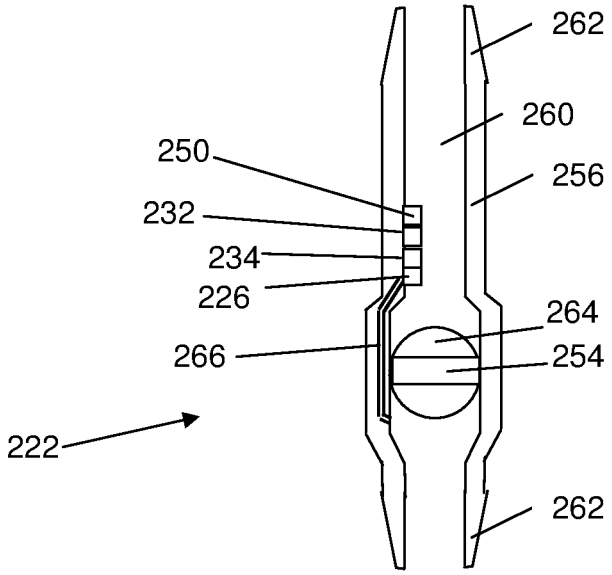
FIG. 7 is a diagrammatic view of a valve according to an alternative embodiment of the present invention.

FIG. 7, for example, shows a valve 222 according to an alternative embodiment of the invention, the valve 222 suitable for use as the uphole valve in the system 10 or the system 100 described above and like components are represented by like numerals incremented by 200. Valve 222 comprises a body 256 having a throughbore 260, connectors 262 for coupling the body 256 to other components or tools (not shown) and a valve member 264 having flow passage 254, which in the illustrated embodiment comprises a ball valve member. As shown in FIG. 7, sensor 226, receiver 250, battery pack 234 and transmitter 232 are disposed uphole of valve member 262, the sensor 226 communicating with the throughbore 260 below the valve member 262 via a conduit or port 266 provided in the body 256.

Figure 8:
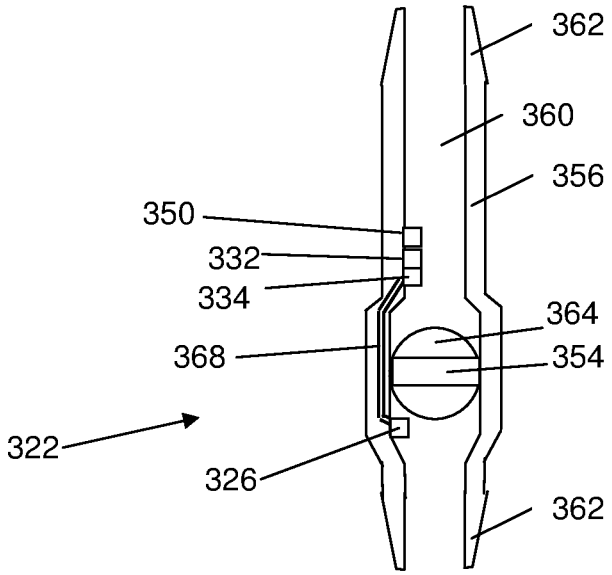
FIG. 8 is a diagrammatic view of a valve according to another embodiment of the present invention.

FIG. 8 shows a valve 322 according to an alternative embodiment of the invention, the valve 322 suitable for use as the uphole valve in the system 10 or the system 100 described above and like components are represented by like numerals incremented by 300. The valve 322 is similar to the valve 222 and comprises a body 356 having a throughbore 360, connectors 362 for coupling the body 356 to other components or tools (not shown) and a valve member 362 having flow passage 354, which in the illustrated embodiment comprises a ball valve member. In this embodiment, receiver 350, battery pack 334 and transmitter 332 are disposed uphole of valve member 362 and sensor 326 is disposed below valve member 362, the sensor 326 communicating with the throughbore 260 below the valve member 262 and with the receiver 350, battery pack 334 and transmitter 332 via a wire 368 provided in the body 356.

Beneficially, disposing part of the communication arrangement at an uphole location relative to the valve member permits components of the system to be repaired or replaced without altering the condition of the uphole valve or otherwise where location of components in the volume between the uphole and downhole valves is limited. Furthermore, additional flexibility in the means of communication between those components disposed uphole of the valve member and surface may be achieved, since this may be achieved by a physical connection, such as electric line or other suitable communicator, which may for example be configured to stab into the system. However, it will be understood that communication may alternatively or additionally be achieved by wireless communication means, such as accoustic or magnetic communication arrangements.

Also, and as shown in the embodiments illustrated in FIGS. 7 and 8, the valve may take the form a valve sub or module, this permitting the valve to be constructed and/or tested prior to deployment in the wellbore.

Also, although the illustrated embodiments shows a subsea well isolation and/or communication system and method, it will be recognised that systems and methods of the present invention may also be used in land-based well isolation applications.

Also, while in the illustrated embodiments the flow passage is shown as being open at its uphole end, the flow passage may alternatively be capped at the uphole end.

The invention claimed is:

1. A system for isolating a wellbore having a fluid flow passage extending from surface to a subterranean location, the system comprising:

a first, downhole, valve member configured for location in the wellbore at a first subterranean location and moveable between a first configuration which permits access through the flow passage and a second configuration which isolates the flow passage below the valve member;

a second, uphole, valve member configured for location in the wellbore at a second subterranean location spaced from the first valve member and moveable between a first configuration which permits access through the second valve member and a second configuration which provides an isolated volume between the first and second valve members;

a monitoring arrangement for obtaining information relating to a condition in the isolated volume; and a communication arrangement for communicating the information relating to the condition in the isolated volume to a remote location, wherein the communication arrangement is configured to transmit or otherwise relay the information relating to the condition in the isolated volume to the remote location via at least one intermediate location.

2. The system of claim 1, wherein at least part of the monitoring arrangement is configured for location in the isolated volume between the first valve member and the second valve member.

3. The system of claim 1, wherein at least one of:

at least part of the communication arrangement is configured for location in the isolated volume between the first valve member and the second valve member; and at least part of the communication arrangement is configured for location outwith the isolated volume between the first valve member and the second valve member.

4. The system of claim 1, wherein at least one of:

the monitoring arrangement is configured to obtain information relating to the integrity of the isolation;

the monitoring arrangement comprises a sensor; and the monitoring arrangement comprises a pressure sensor.

5. The system of claim 1, comprising a memory device for storing the information obtained by the monitoring arrangement.

6. The system of claim 1, wherein the communication arrangement comprises at least one of: a wireless communication arrangement; an acoustic communication arrangement; a wired communication arrangement; an electric line communication arrangement; an optical communication arrangement; a waveguide communication arrangement; and an optical fiber.

7. The system of claim 1, comprising a power supply, the power supply comprising one of: a battery; a battery pack; an alkaline battery; and an alkaline battery pack.

8. The system of claim 1, wherein the at least one intermediate location comprises a first intermediate location and the system comprises a first receiver/transmitter or transceiver disposed at the first intermediate location.

9. The system of claim 8, wherein the first receiver/transmitter or transceiver is located at a subterranean location in the wellbore.

10. The system of claim 1, wherein the at least one intermediate location comprises a second intermediate location and the system comprises a second receiver/transmitter or transceiver disposed at the second intermediate location.

11. The system of claim 10, wherein the second receiver/transmitter or transceiver is located at a subsurface location or on the seabed.

12. The system of claim 1, wherein the communication arrangement is configured to relay the information relating to the condition in the isolated volume at a given time interval.

13. The system of claim 1, wherein the communication arrangement is configured to receive information or commands.

14. The system of claim 1, comprising a body for running the first and second valve members into the wellbore.

15. The system of claim 1, wherein at least one of the first valve member and the second valve member comprises a ball valve.

16. The system of claim 14, comprising a seal member for sealing an annulus between the body and a wall of the flow passage.

17. A method for isolating a wellbore having a flow passage extending from surface to a subterranean location, the method comprising:

locating a first, downhole, valve member at a first subterranean location in a wellbore;

locating a second, uphole, valve member at a second subterranean location in the wellbore spaced from the first valve member;

moving the first valve member between a first configuration which permits access through the flow passage to a second configuration which isolates the flow passage below the valve member;

moving the second valve member between a first configuration which permits access through the second valve member and a second configuration which provides an isolated volume between the first and second valve members;

obtaining information relating to a condition in the isolated volume; and communicating the information relating to the condition in the isolated volume to a remote location via at least one intermediate location.

18. The method of claim 17, wherein the first valve member and the second valve member are located in the bore in a single trip.

19. The method of claim 17, comprising at least one of:

performing an integrity test on the first valve member by applying a pressure above and/or below the first valve member to pressure test the integrity of the first valve member; and performing an integrity test on the second valve member by monitoring the pressure across the second valve member.

20. The system of claim 1, wherein the monitoring arrangement, or part of the monitoring arrangement, is configured for location outwith the isolated volume between the first valve member and the second valve member.

* * * * *